US006042527A

United States Patent [19]

Anderson et al.

[11] Patent Number: 6,042,527

[45] Date of Patent: Mar. 28, 2000

[54] CARTON FORMING DEVICE

[75] Inventors: Paul Anderson, Addison; Anders H. Johansson, Buffalo Grove; Anders Andren, Palatine, all of Ill.

[73] Assignee: Tetra Laval Holdings & Finance, SA, Pully, Switzerland

[21] Appl. No.: 09/016,094

[22] Filed: Jan. 30, 1998

[51] Int. Cl.[7] ..... B31B 1/80

[52] U.S. Cl. ..... 493/316; 493/152

[58] Field of Search ..... 53/564, 565, 566, 53/563; 493/313, 316, 317, 165, 153, 152

[56] References Cited

U.S. PATENT DOCUMENTS

| | | | |
|---|---|---|---|
| 1,001,268 | 8/1911 | Heyback . | |
| 2,357,535 | 9/1944 | Monroe . | |
| 2,831,407 | 4/1958 | Pittman et al. . | |
| 3,002,328 | 10/1961 | Monroe et al. . | |
| 3,207,049 | 9/1965 | Monroe et al. . | |
| 3,217,463 | 11/1965 | Stannard et al. | 53/564 |
| 3,364,826 | 1/1968 | Austin, Jr. et al. . | |
| 3,466,837 | 9/1969 | Sturges . | |
| 3,566,762 | 3/1971 | Vadas et al. . | |
| 3,690,223 | 9/1972 | Klausmann et al. . | |
| 4,011,799 | 3/1977 | Chidsey . | |
| 4,018,143 | 4/1977 | Dice et al. | 53/564 X |
| 4,041,850 | 8/1977 | Reichert . | |
| 4,201,118 | 5/1980 | Calvert . | |
| 4,448,008 | 5/1984 | Pankratz et al. | 53/565 X |
| 5,007,889 | 4/1991 | Wakabayashi et al. | 493/316 |
| 5,097,649 | 3/1992 | Ueda et al. . | |
| 5,180,356 | 1/1993 | Wakabayashi et al. . | |
| 5,411,464 | 5/1995 | Calvert et al. | 493/317 X |
| 5,469,690 | 11/1995 | Nordell . | |
| 5,561,968 | 10/1996 | Palmer | 53/566 X |

*Primary Examiner*—Linda Johnson
*Attorney, Agent, or Firm*—Welsh & Katz, Ltd.

[57] ABSTRACT

An apparatus and method for forming an erected carton from a blank for cartons having non-traditional configurations is disclosed herein. Such non-traditional configurations may include beveled edge cartons and eight-sided cartons. The apparatus includes rolling means for breaking a first set of crease lines on the blank, force exertion means for breaking a second set of crease lines on the blank, and maintenance means for maintaining the shape of en erected carton. The present invention also includes a mandrel configured to substantially match the side configuration of a carton such as a beveled edge carton.

9 Claims, 14 Drawing Sheets

CARTON FORMING DEVICE

CROSS REFERENCES TO RELATED APPLICATIONS

Not Applicable

STATEMENT REGARDING FEDERALLY SPONSORED RESEARCH OR DEVELOPMENT

Not Applicable

BACKGROUND OF THE INVENTION

1. Field of the Invention

The present invention relates to carton forming machinery. Specifically, the present invention relates to a carton erection arrangement between a supply of carton blanks and a mandrel arrangement on a form, fill and seal packaging machine in order to erect a carton having a non-traditional configuration.

2. Description of the Related Art

Traditionally, cartons such as the familiar gable top carton have been formed on form, fill and seal packaging machines from flat blanks which are fed from a magazine. The blanks are erected on the magazine and transported to a bottom forming station which is usually a mandrel wheel. Once the bottom is formed, the cartons are placed on a conveyor for transport to further stations on the packaging machine. The traditional gable top carton has four sides and erecting the carton is accomplished by pushing on one edge of the blank to break the crease lines of the blank. Numerous inventions have been set forth for erection of traditional gable top cartons.

Most recently, the configurations of containers has become of renowed interest in the packaging industry. Although most of this configuration activity has taken place in plastic bottles, there has been some activity for cartons fabricated from blanks. One such carton is a beveled edge carton available from Tetra Pak, Inc. of Chicago, Ill. Another carton is an eight-sided gable top carton, also available from Tetra Pak, Inc. These non-traditional configuration cartons present a difficult problem to the packaging industry, that is properly erecting the carton for fabrication on a form, fill and seal packaging machine. As of yet, the packaging industry has been unable to resolve this problem and the problem of proper bottom forming of such a non-traditional configuration carton.

BRIEF SUMMARY OF THE INVENTION

The present invention provides a solution for forming a carton having a non-traditional configuration such as a beveled edge carton or an eight-sided carton. The present invention may be utilized on form, fill and seal packaging machine to provide erected cartons having a non-traditional configuration.

One aspect of the present invention is an apparatus for forming a carton from a flat blank. The apparatus includes a plurality of vacuum grips, a pusher plate and a plurality of guides. Another aspect of the present invention includes a method for forming an erected carton from a blank. The first step is providing a blank followed by rolling the blank to break a first set of crease lines. Next, a force is exerted on the blank to break a second set of crease lines in order to erected the carton. This is followed by engaging a plurality of guides to maintain the erected shape of the carton. Yet another aspect of the present invention is an apparatus for forming a carton from a carton blank on a frame. The frame has an ingress and an egress, and means for rolling a blank, means for exerting a force on a blank, and means for maintaining the shape of an erected carton.

It is a primary object of the present invention to provide a carton forming arrangement for erecting a carton having a non-traditional configuration.

It is an additional object of the present invention to provide a method for erecting a carton having a non-traditional configuration.

It is yet an additional object of the present invention to provide a carton forming arrangement for erecting a carton with beveled edges.

It is yet an additional object of the present invention to provide a mandrel for bottom forming of a carton having a non-traditional configuration.

Having briefly described this invention, the above and further objects, features and advantages thereof will be recognized by those skilled in the pertinent art from the following detailed description of the invention when taken in conjunction with the accompanying drawings.

BRIEF DESCRIPTION OF THE SEVERAL VIEWS OF THE DRAWINGS

Several features of the present invention are further described in connection with the accompanying drawings in which:

There is illustrated in FIG. 1 a schematic view of a packaging machine utilizing the carton forming device of the present invention;

Figure 2:
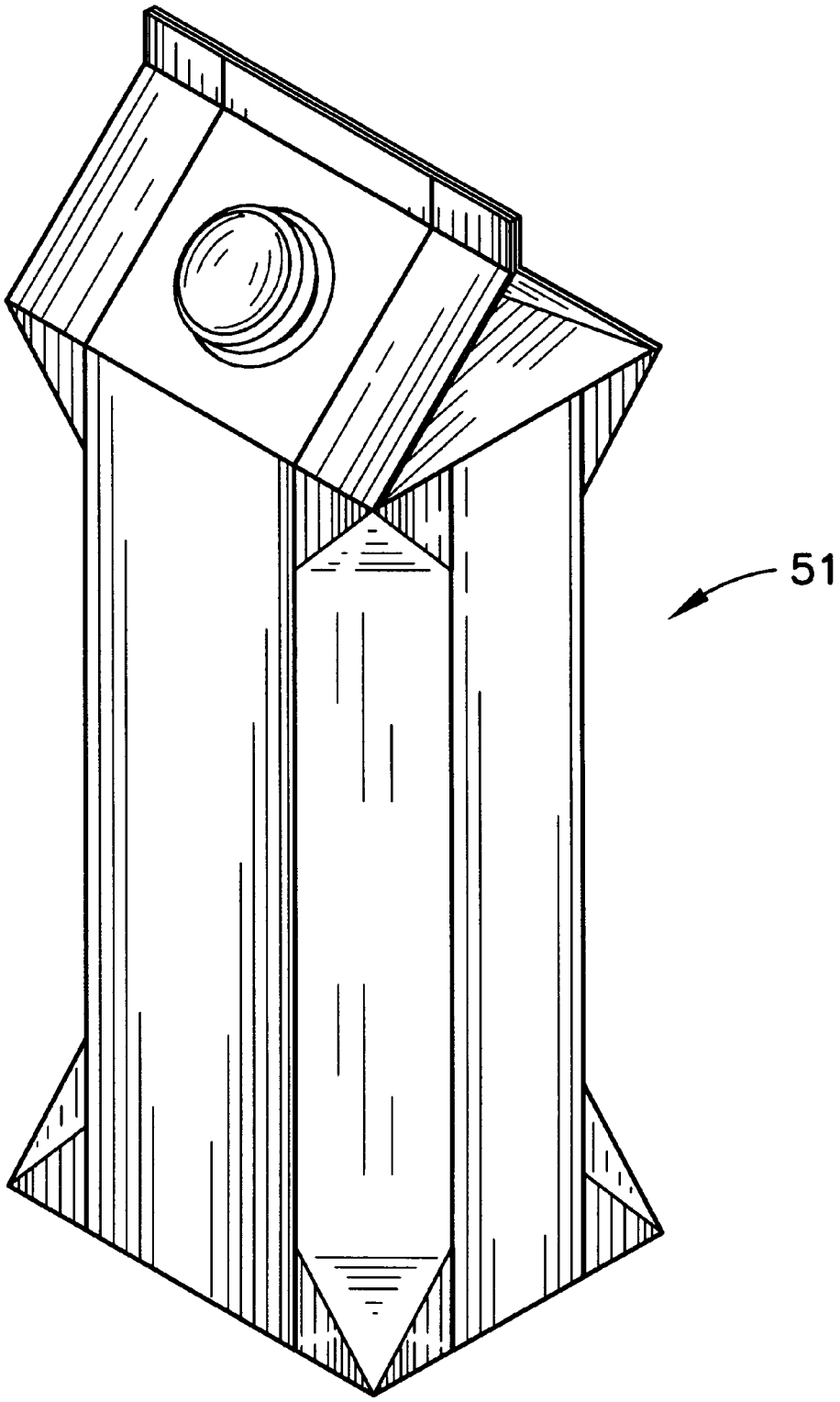
Figure 3:
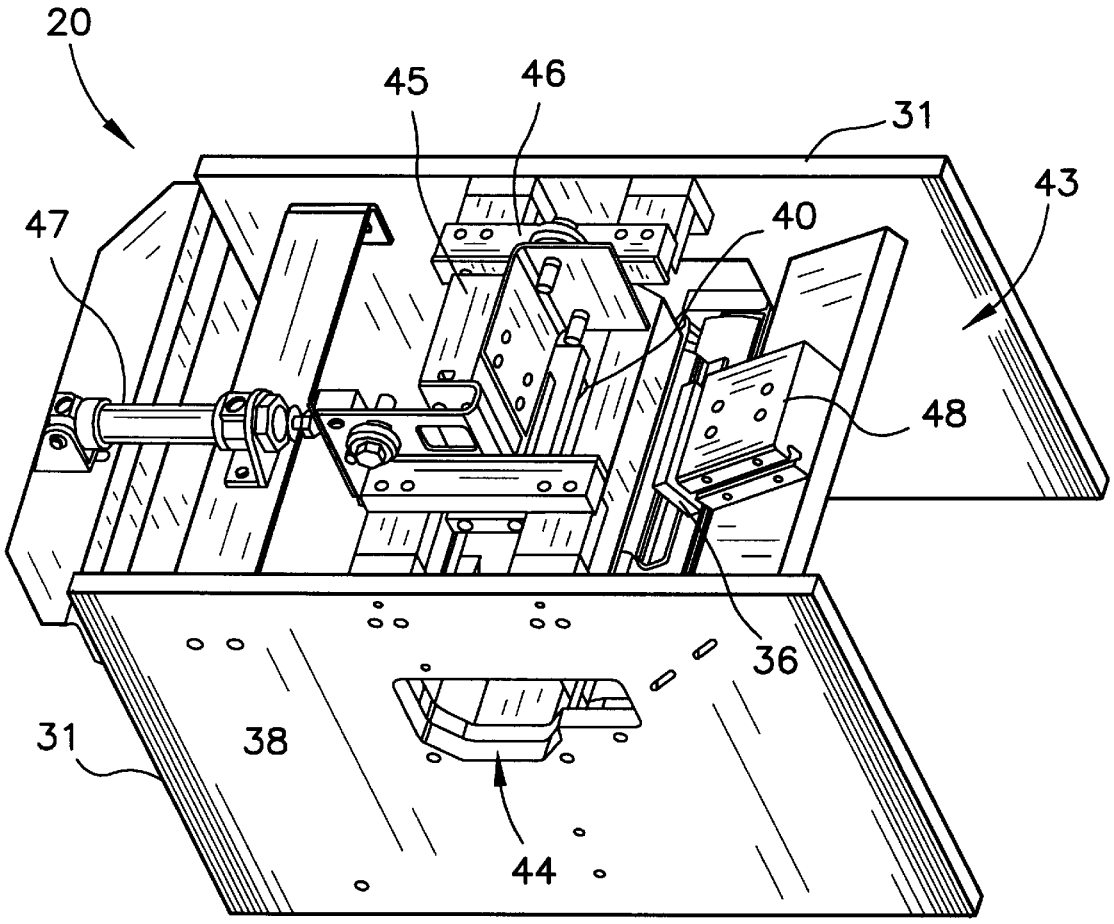
Figure 3A:
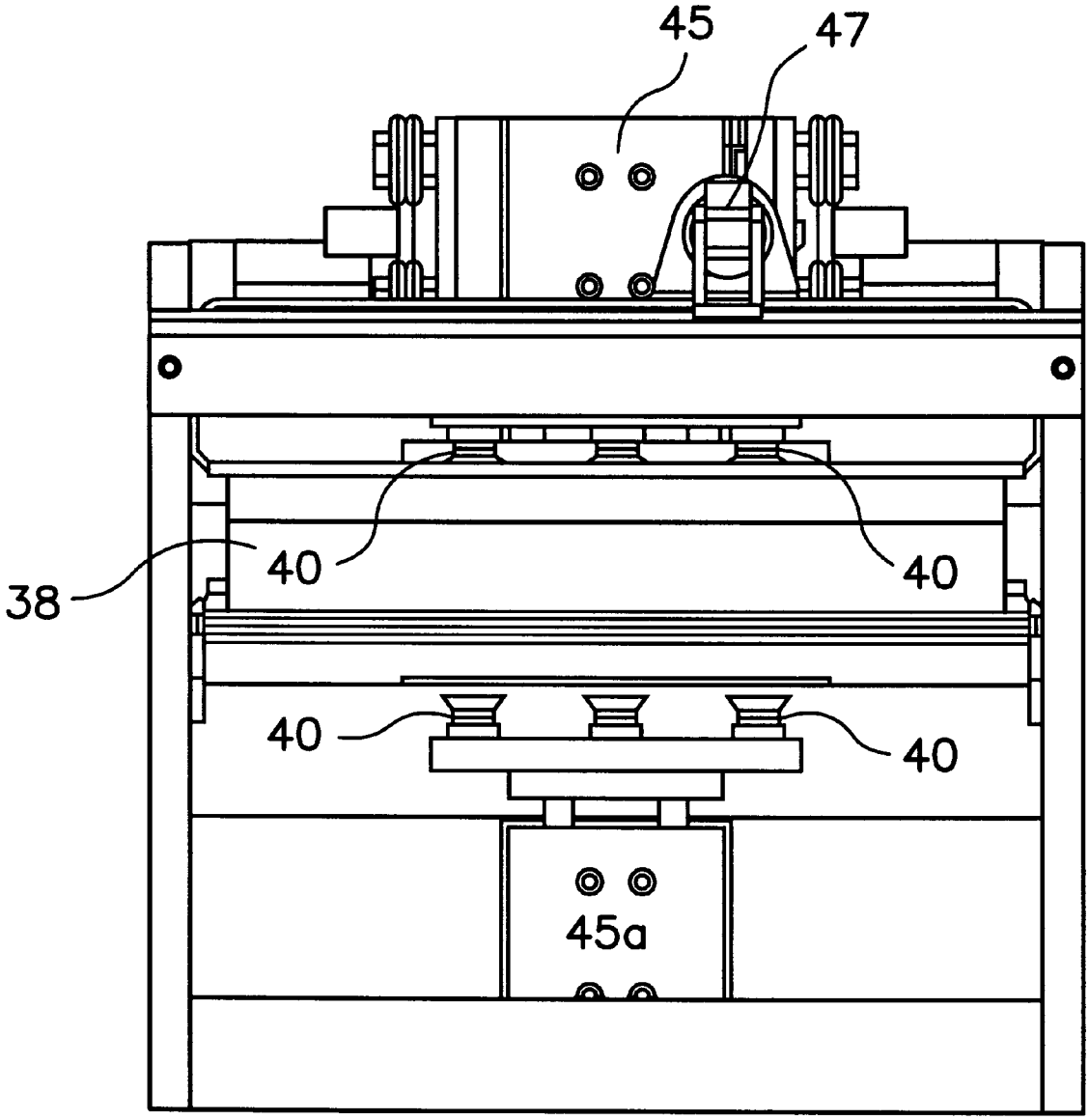
Figure 3B:
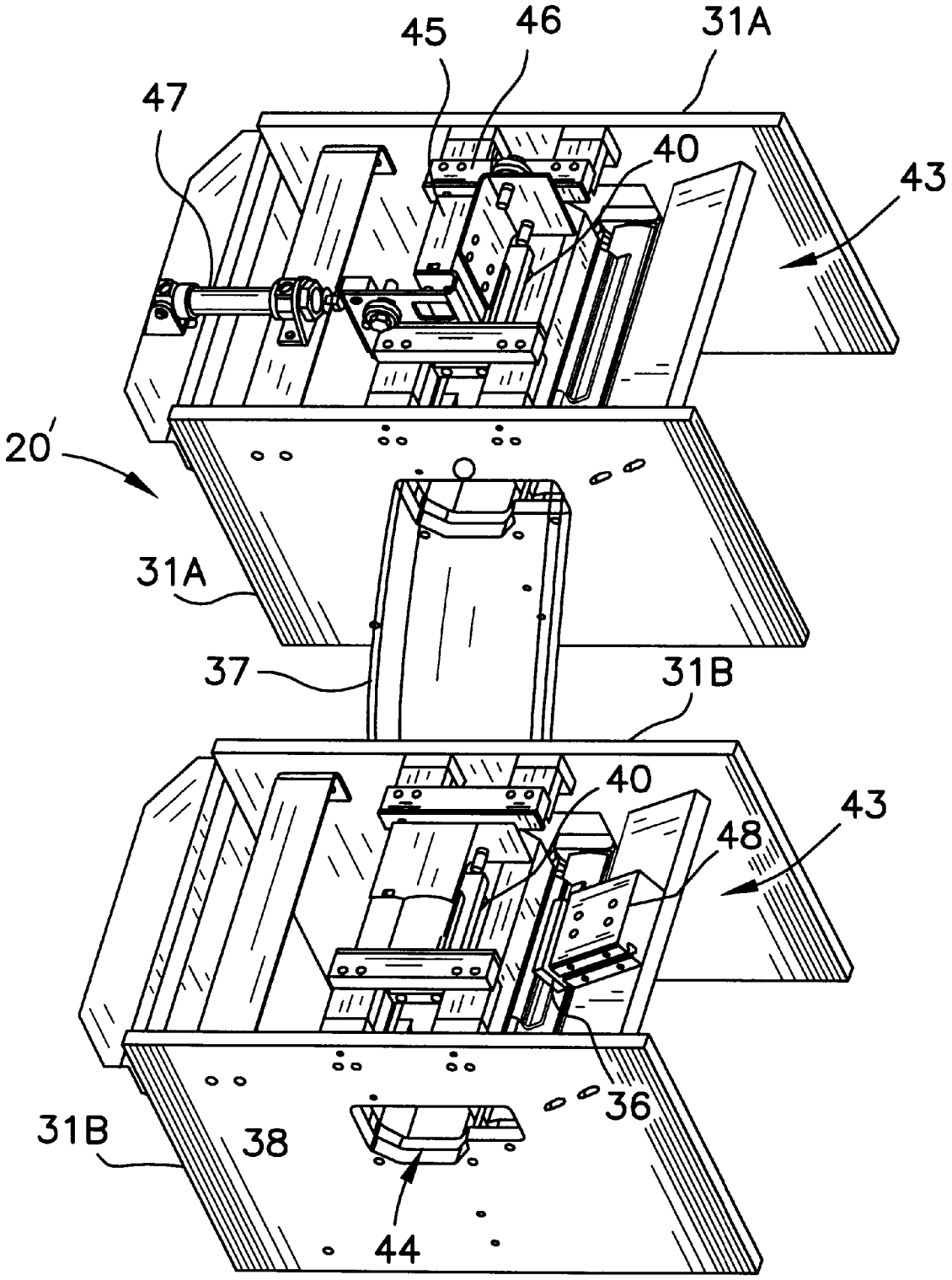
Figure 4A:
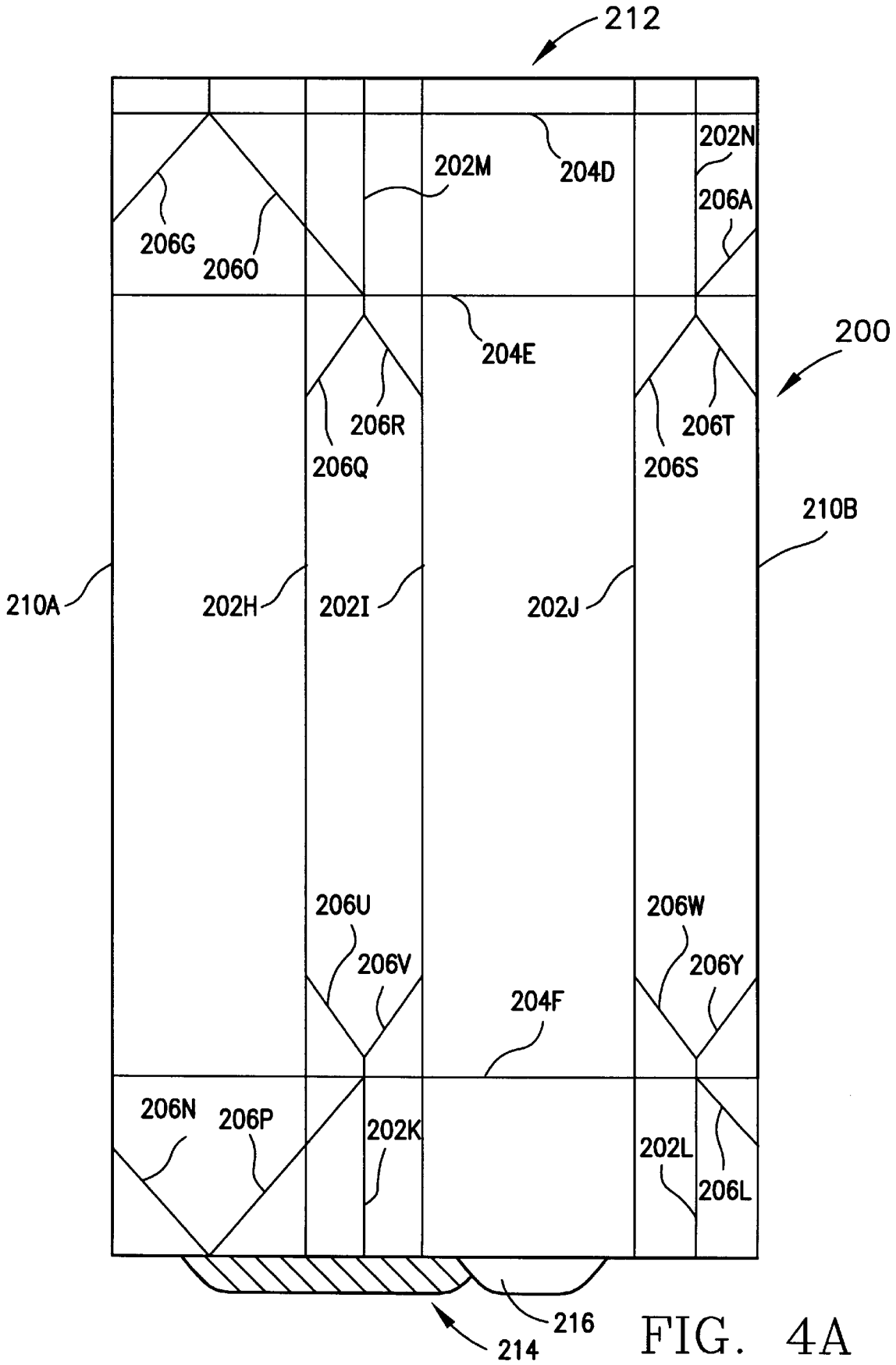
Figure 4B:
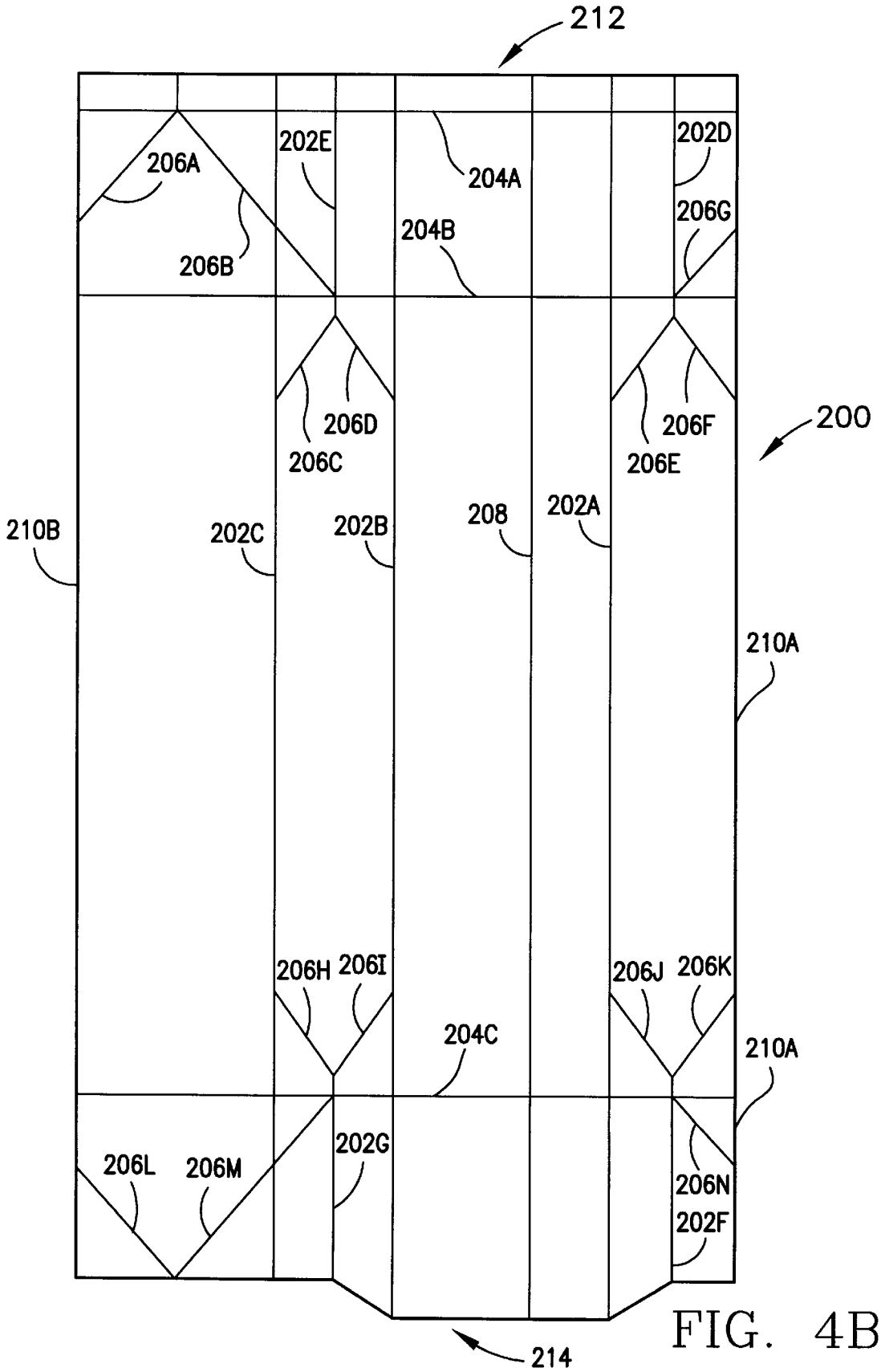
Figure 4C:
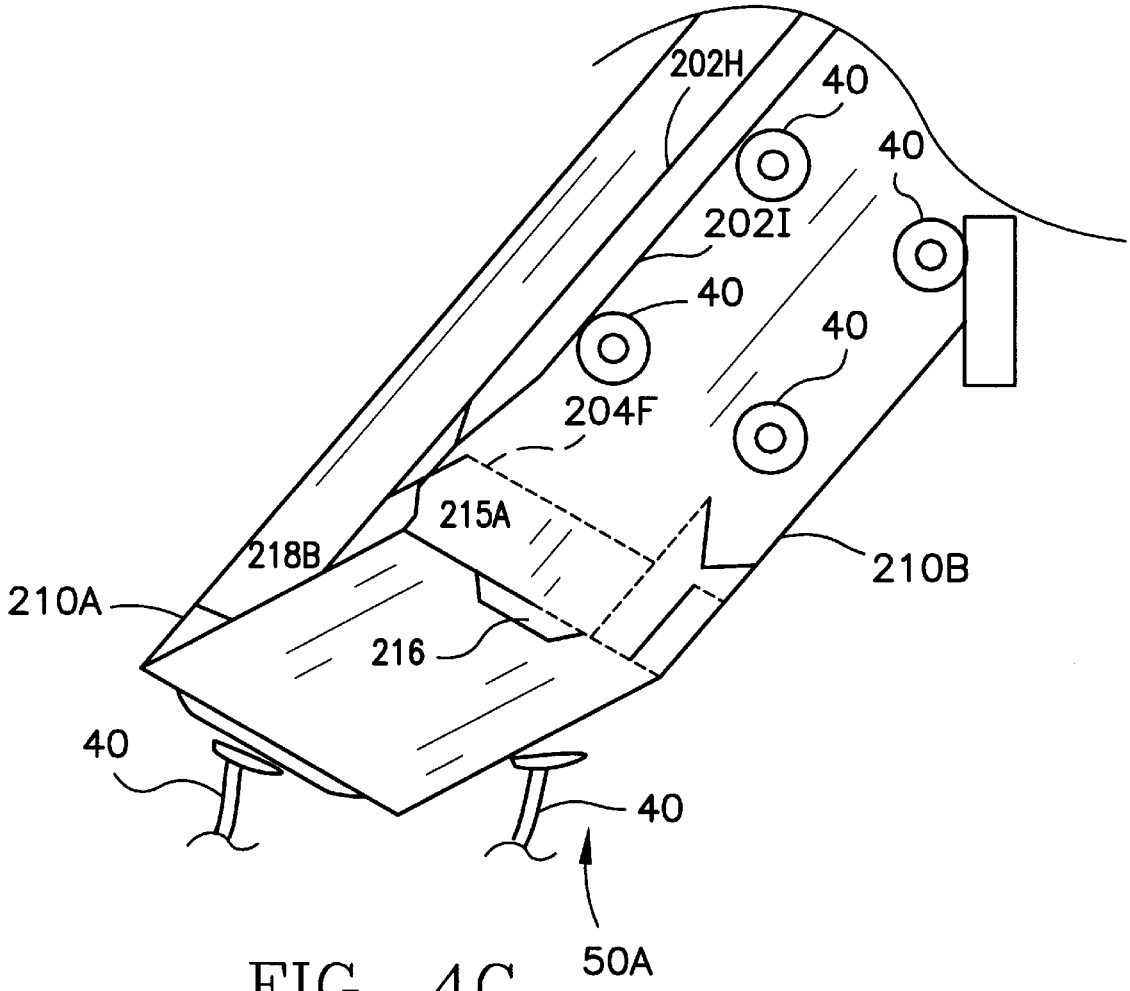
Figure 4D:
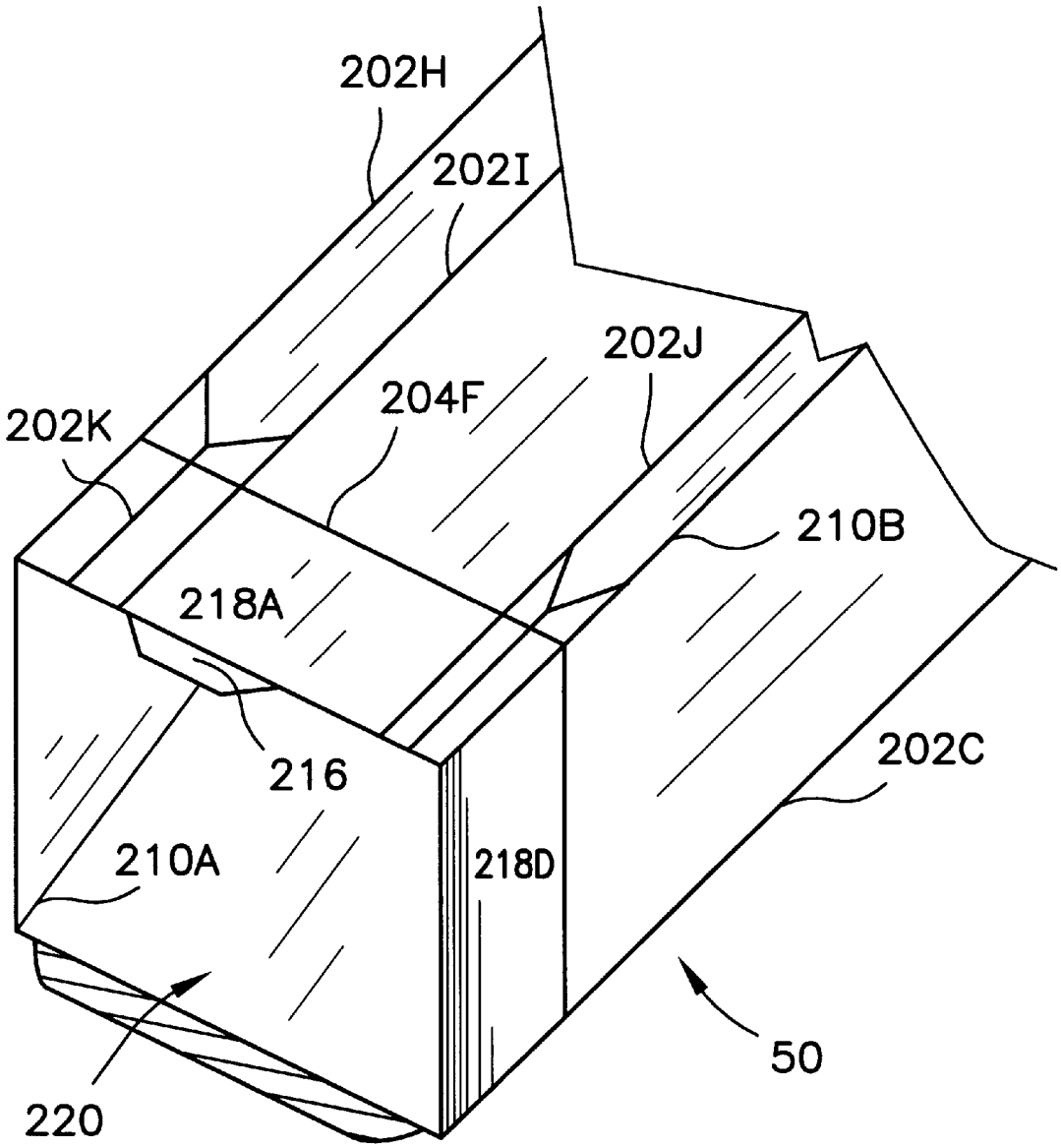
Figure 4E:
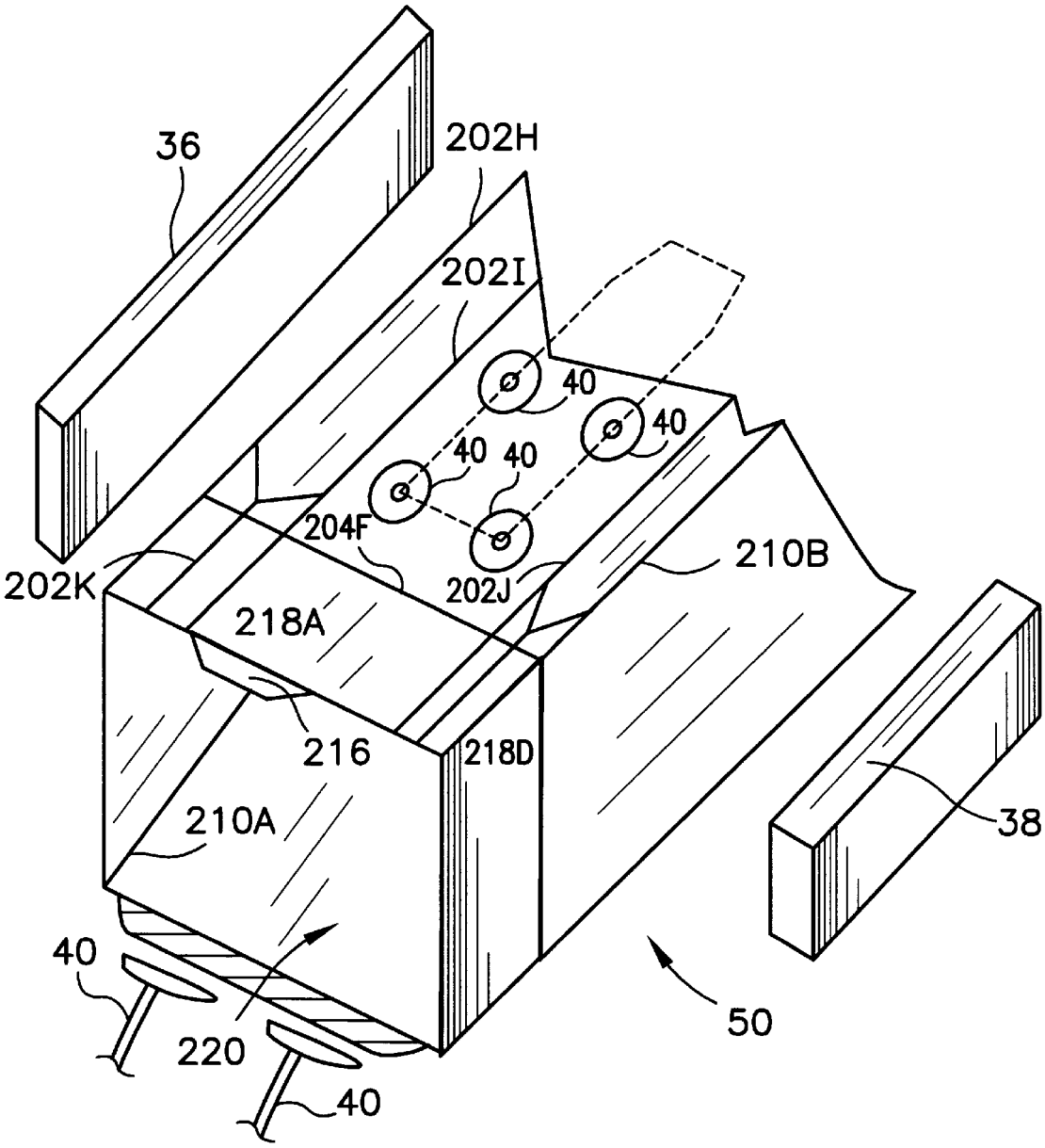
Figure 4F:
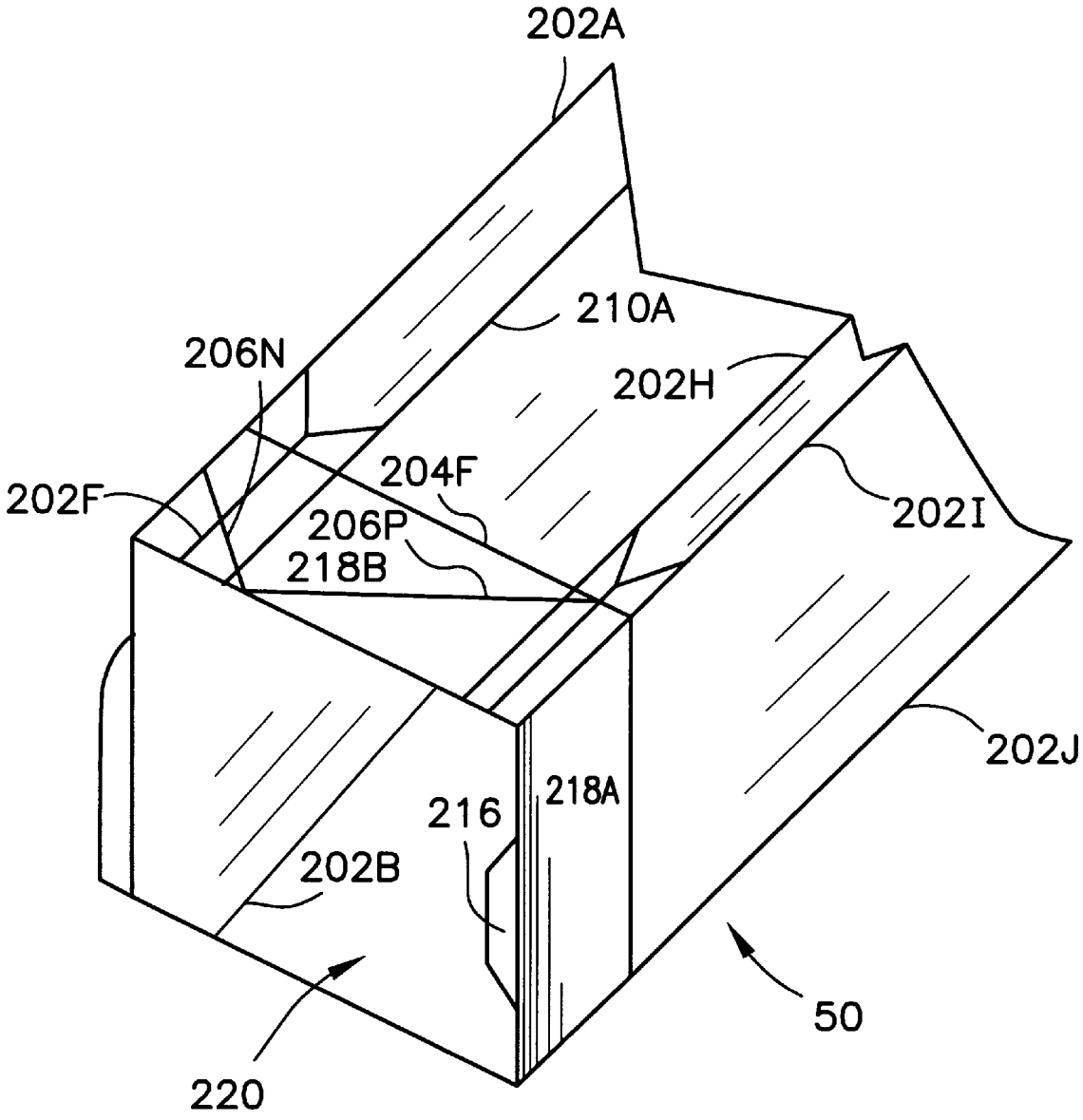
Figure 4G:
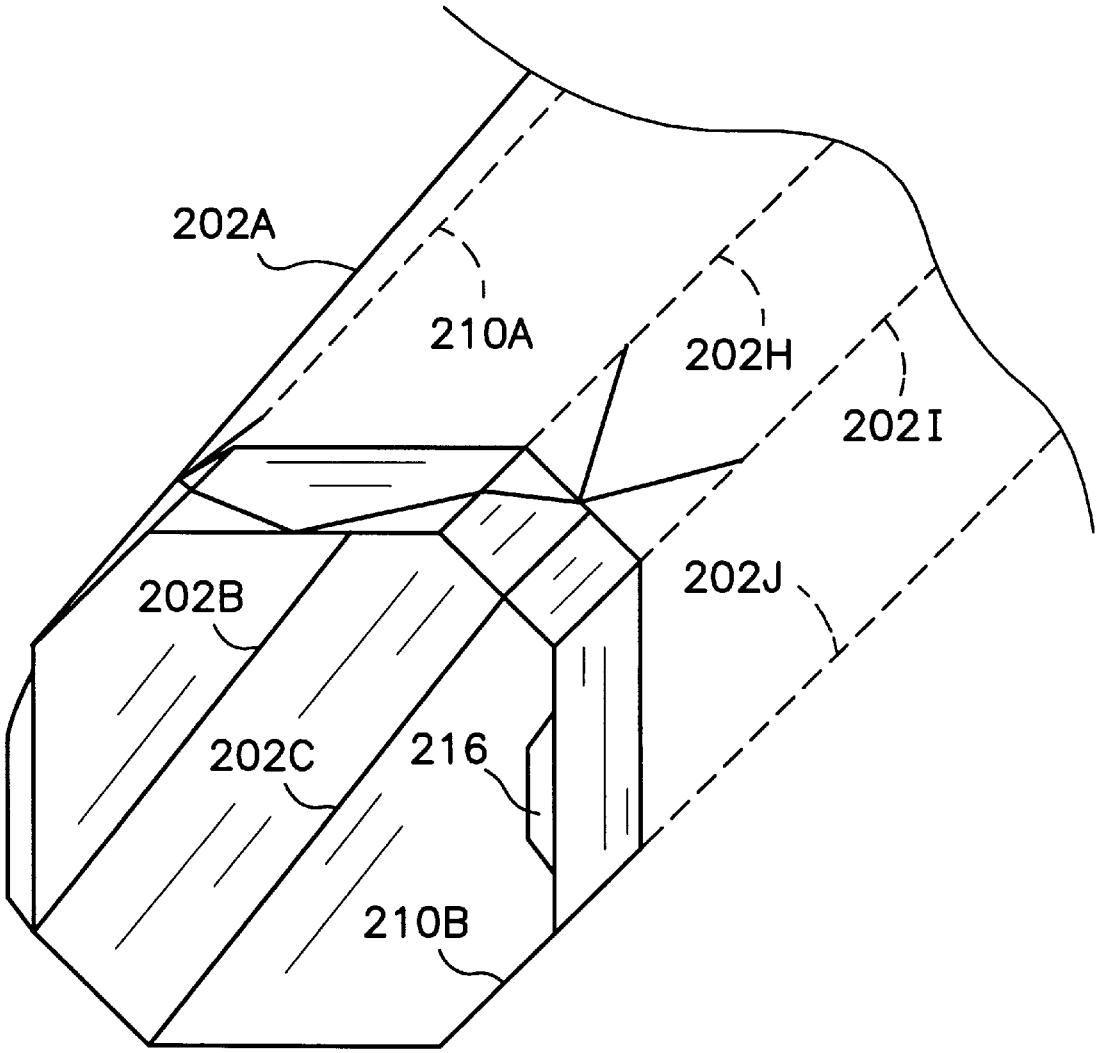
Figure 5:
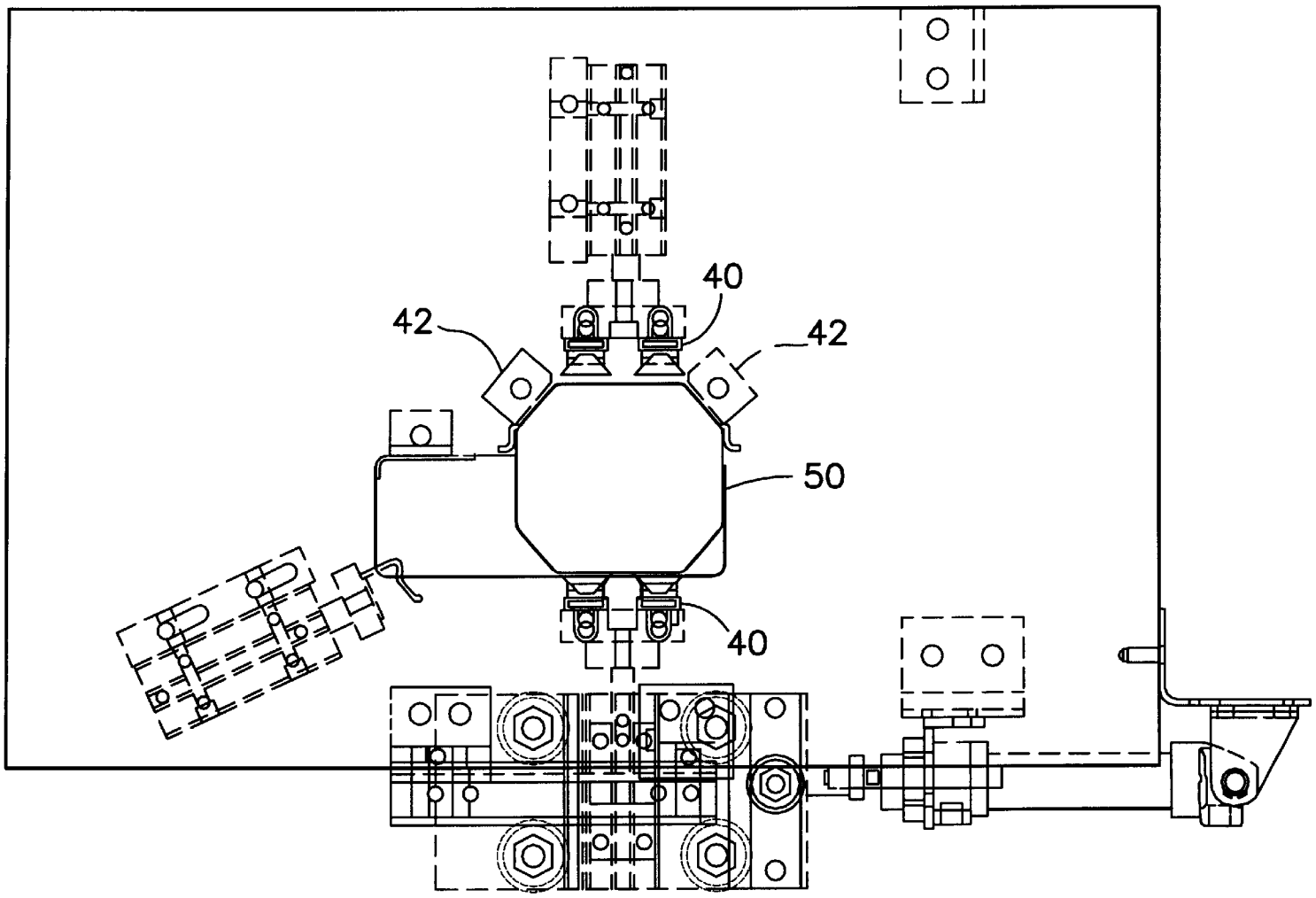
Figure 6:
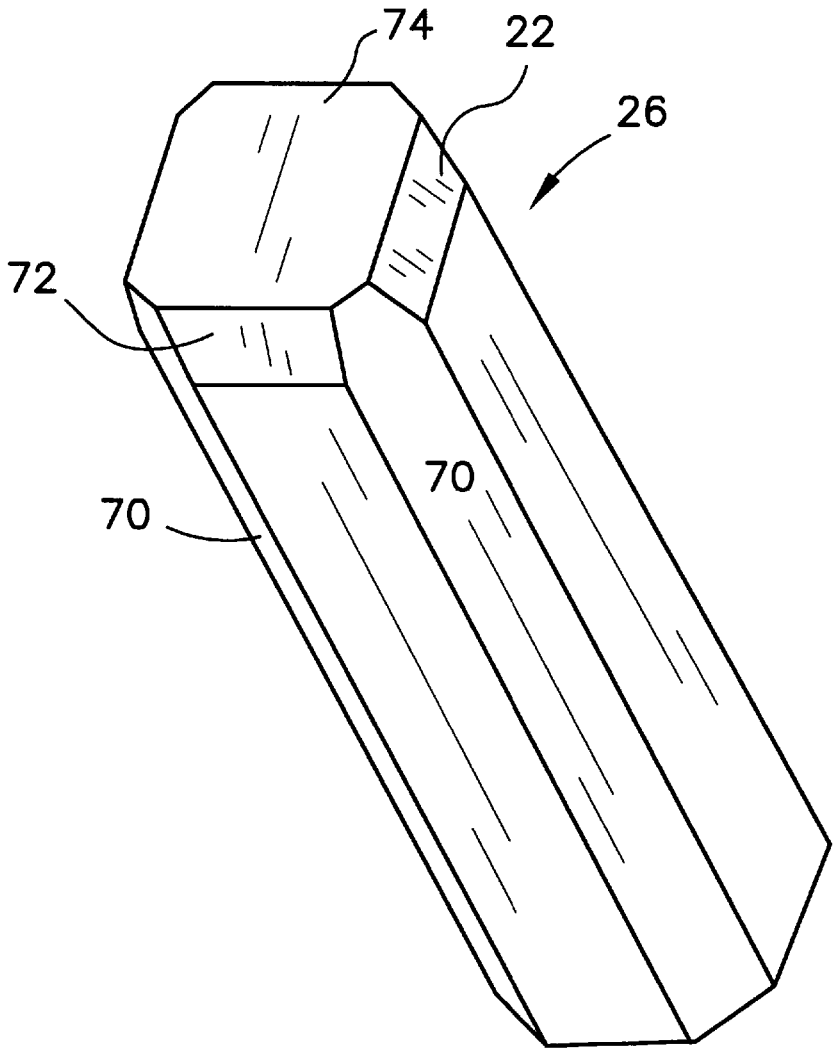
Figure 6A:
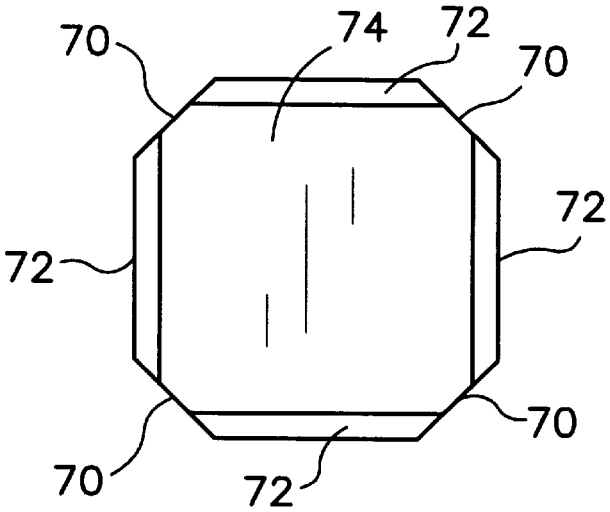

There is illustrated in FIG. 2 a form, filled and sealed beveled edge carton which may be formed by the present invention;

There is illustrated in FIG. 3 a top perspective view of the carton forming device of the present invention;

There is illustrated in FIG. 3A a cut-away side view of the carton forming device of the present invention;

There is illustrated in FIG. 3B a top perspective view an alternative embodiment of the carton forming device of the present invention;

There is illustrated in FIG. 4A a plan view of one side of a carton blank for a beveled edge carton;

There is illustrated in FIG. 4B a plan view of the opposite side of the carton blank of FIG. 4A;

There is illustrated in FIG. 4C a cut-away view of the carton blank of FIGS. 4A and 4B undergoing rolling to break a first set of crease lines on the carton forming device of the present invention;

There is illustrated in FIG. 4D a cut-away view of the carton blank of FIGS. 4A and 4B in the first rectangled shape on the carton forming device of the present invention;

There is illustrated in FIG. 4E a cut-away view of the carton blank of FIGS. 4A and 4B undergoing the breaking of a second set of crease lines on the carton forming device of the present invention;

There is illustrated in FIG. 4F a cut-away view of the carton blank of FIGS. 4A and 4B in the second rectangled shape on the carton forming device of the present invention;

There is illustrated in FIG. 4G a cut-away view of the carton blank of FIGS. 4A and 4B in an erected carton shape on the carton forming device of the present invention;

There is illustrated in FIG. 5 a cut-away side view of the carton blank of FIGS. 4A and 4B engaged with the guides of the carton forming device of the present invention;

There is illustrated in FIG. 6 a top perspective view of a mandrel of the present invention;

There is illustrated in FIG. 6A a top plan view of the mandrel of FIG. 6.

DETAILED DESCRIPTION OF THE INVENTION

Figure 1:
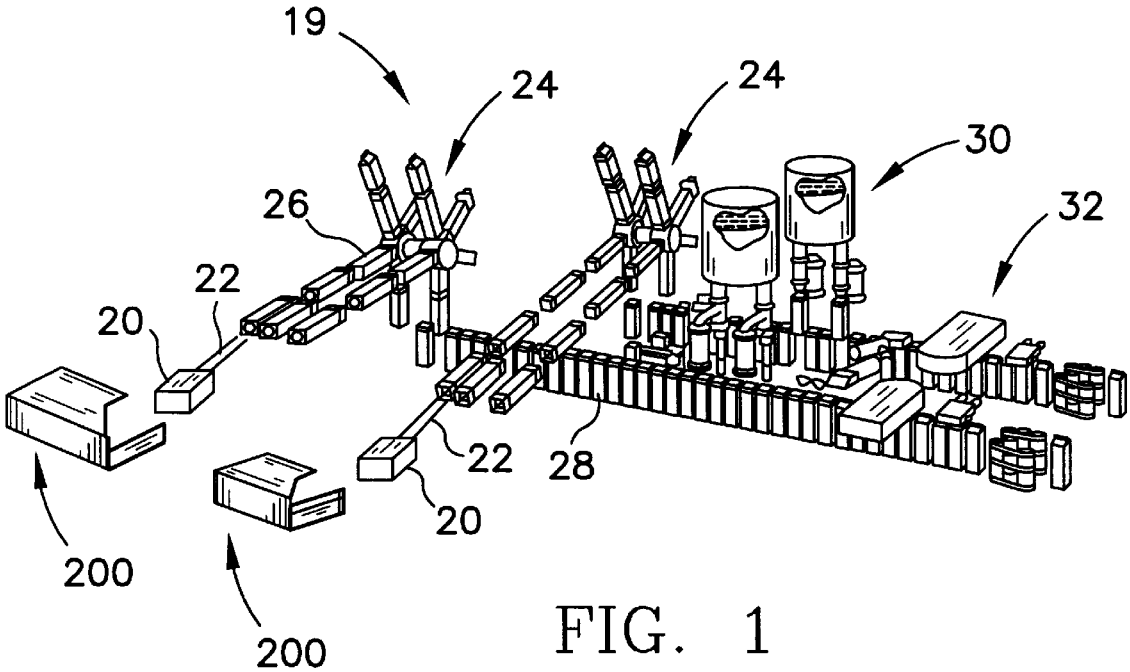

The present invention is directed at the transition from blank to erected carton for a placement on a form, fill and seal packaging machine, such as a TETRA REX® packaging machine available from Tetra Pak, Inc. of Chicago, Ill. As shown in FIG. 1, a packaging machine 19 transforms a plurality of blanks 200 into a plurality of formed, filled and sealed cartons. The carton forming device 20 of the present invention may either be a component of a magazine, positioned between a magazine and the mandrel wheel 24 of the packaging machine 19. A rail 22 transports the erected carton blanks to the mandrel wheel 24 for placement on a mandrel 26. The bottom of the carton is formed at the mandrel wheel 24. From their, the erected carton 50 is transported on a conveyor 28 to other stations on the packaging machine 19. These stations may include a fitment applicator station an/or a sterilization station, neither shown. The packaging machine 19 will have a filling station 30 and a top sealing station 32. As is apparent from FIG. 1, the shape of the carton is not problematic once the carton is erected, bottom formed and placed on the conveyor 28. The problem with cartons that have a non-traditional shape, that is adjacent sidewalls of the carton are not perpendicular to each other, is in erecting and bottom forming the carton. An example of such a carton 51 is shown in FIG. 2, which is embodied in copending U.S. patent application Ser. No. 09/005,804 for a Beveled Edge Carton, filed Jan. 12, 1998 which is hereby incorporated by reference. Another example of such a carton is found in copending U.S. patent application Ser. No. 08/902,457 for an Eight-Sided Gable-Top Carton filed on Jul. 29, 1997 which is also hereby incorporated by reference. The present invention resolves this problem as described below.

As shown in FIGS. 3 and 3A, the carton forming device 20 of the present invention generally includes a frame 31, a first pusher plate 36, a stopper 38 (second pusher plate), a plurality of vacuum grips 40, and a plurality of guides 42. Blanks 200, as described in reference to FIG. 4A and 4B, enter the device 20 through ingress 43 and exit through egress 44 onto the rails 22 to the mandrel wheel 24. The plurality of grips 40 which are disposed above the blank 200 are controlled by a linear actuator/cylinder 45 (may also be a servomotor) which actuates the vacuum and the longitudinal movement of the grips 40 in relation to the blank 200. The cylinder 45 and grips 40 are mounted on a moveable frame 46 which is connected to a pneumatic piston 47 for transverse movement in relation to the blank 200. The first pusher 36 is connected to a cylinder 48 which controls the movement of the pusher plate 36. Additionally, the stopper 38 is controlled by a cylinder, not shown. The operation of the carton forming device is described in reference to FIGS. 4A–F which illustrate the various operations on a carton blank 200.

Alternatively, as shown in FIG. 3B, the carton forming device 20' may be divided for increased production speed, that is faster erection of the cartons. In this alternative, the blank enters a frame 31*a*, which is similar to frame 31 except the pusher plate 36 and the stopper 38 are absent. In this first frame 31*a*, the first set of crease lines are broken. Then, the partially erected carton is transported to a second frame 31*b*, via rollers 37, which is the same as frame 31 of FIG. 3. The rollers 37 maintain the first rectangle shape of the carton until the carton arrives at the second frame 31*b*. In the second frame 31*b*, the second set of crease lines are broken then the erected carton is transported via the rail 22 to the mandrel wheel 24.

As shown in FIGS. 4A and 4B, a carton blank 200 is defined by a plurality of vertical crease lines 202A–N, horizontal crease lines 204A–F and diagonal crease lines 206A–Y. The crease lines define the final shape of the carton, and allow for folding of the blank into a carton on a packaging machine and its attachments such as a magazine.

Each blank 200 enter the device 20 in a flat shape with the top 212 facing in a predetermined direction and the bottom 214 in the opposite direction. Proper orientation of each blank 200 is necessary for placement of the erected carton 50 on the mandrel 26 for bottom forming. The bottom panels 218 of the carton must be extending outward from the mandrel 26 in order to be folded and sealed to create the bottom of the carton.

As shown in FIG. 4C, the blank 200 is partially erected by "rolling" the blank to "rectangle" the shape of the blank 200. This rolling is accomplished by the plurality of grips 40 vacuumly engaging with the blank 200 as the it enters the forming device 20. The grips 40 should engage closest to the crease lines to be broken in order to prevent damage to the blank 200. Once engaged with the blank 200, the grips 40 move upward and transverse to the longitudinal length (top to bottom) of the blank 200 thereby rolling the blank 200. The upward motion is controlled by the cylinder 45 while the transverse motion is controlled by the piston. Other means for rolling the blank 200 could include hooks which attach the interior and then roll the blank 200, pushing the edge 210*a* with the pusher plate 36 to roll the blank, or the like. The "diamonded" carton 50A of FIG. 4C is the intermediate step from a flat blank 200 the "rectangled" carton 50B of FIG. 4D. If the erected carton 50 has a rectangular cross-section instead of a square cross-section, then upon rolling the blank 200 will be also "rectangled". The rolling also breaks the first set of crease lines to form the rectangled carton 50B of FIG. 4D. In the example shown, the first set of crease lines broken are the vertical crease lines 202C and 202H. However, those skilled in the pertinent art will recognize that other blanks for cartons having different shapes may have different crease lines broken at this stage. If the two-stage operation of FIG. 3B is utilzed, then the erected carton 50B is transported to the second frame 31*b* at this point in time.

As shown in FIG. 4D, the vertical crease line 202H is an edge of the rectangle of the rectangled carton 50B. The vertical crease line 202I lies in the horizontal plane defined by the edge 210B and the vertical crease line 202H which is perpendicular to the vertical plane defined by the vertical crease line 202C and the edge 210B. Focusing on the interior 220 of the carton, the opposite side of the vertical crease line 210B is shown with form the other edge of the rectangle of the rectangled carton 50B. Thus, the rectangle of the erected carton is defined by the edge 210A, the vertical crease line 202H, the edge 210B and the vertical crease line 202C.

From the "rectangled state", the sides of the erected carton 50 are completely shaped by exerting a force on the rectangled carton 50B as shown in FIG. 4E. The plurality of vacuum grips 40, still attached to the side panels of the squared carton 50B on the upper side and on the lower side of the rectangled carton 50B are retracted away from the carton to exert an outward force on the rectangled carton

50B. The outward force extends upward and downward thereby breaking the second set of crease lines to form a second rectangled carton 50C. The second set of crease lines to be broken includes the vertical crease lines 202I, 202A, 202J and 202B. If the grips 40 are unable to completely break the second set of crease lines, the first pusher 36 and the stopper 38 (which may act as a pusher) are employed to exert a horizontal inward force on the rectangled carton 50B, which may or may not be simultaneously performed with the action of the grips 40. However, those skilled in the pertinent art will recognize that other blanks for cartons having different shapes may have different crease lines broken at this stage. The second rectangled erected carton 50C is shown in FIG. 4F.

When the grips 40, the pusher plate 36 and the stopper 38 release the erected carton 50C, the erected carton 50C develops into the beveled edged carton, erected carton 50, is shown in FIG. 4G. Additionally, line 250 illustrates an imaginary longitudinal center axis on which the erected carton 50 may be rotated about.

As shown in FIG. 4G, the side panel defined by the edge 210A and the vertical crease line 202H lies in a horizontal plane which is perpendicular to the vertical plane I which the side panel defined by the vertical crease lines 202I and 202J. The beveled edge defined by the vertical crease lines 202H and 202I is at an angle to the afore-mentioned horizontal and vertical planes.

As shown in FIG. 5, the erected carton 50 is maintained in its erected shape by a plurality of guides 42 which guide the erected carton from the device 20 to the mandrel of the mandrel wheel 24 for bottom forming. The guides 42 may be rollers, or moveable plates, or the like. The function of the guides 42 is maintain the shape of the erected carton 50 from the device 20 to the mandrel wheel 24, and any means which accomplishes this function may be utilized as a guide.

The mandrel 26 is shown in FIGS. 6 and 6A. The mandrel 26 is configured to substantially match the configuration of the carton to be bottom formed on the mandrel 22. For a beveled edge carton 51, as shown in FIG. 2, the mandrel 26 will have beveled edges 70 for side forming, and beveled tops 72 for bottom forming. Essentially on the mandrel wheel 24, each mandrel 26 is rotated to several stations which perform various tasks on the erected carton 50. After placement of the erected carton 50 on the mandrel 26, the mandrel 26 is rotated to a pre-folding station where the bottom panels 218 are broken. This station may also have a sterilization function wherein a sterilant is introduced to the bottom panels. Next, the mandrel 26 is rotated to a bottom heating station where the bottom panels 218 are heated in preparation for the next station. At the next station, the bottom panels folded and sealed together to form the bottom of the carton. It is important that the mandrel cap 74 is configured accommodate proper bottom forming. For a beveled edge carton 50, this involves having beveled tops 72. Improper bottom forming could lead to leakage, or enhance the possibility of wicking. The mandrel 26 allows for the proper bottom forming of a beveled edge carton 51. Other non-traditional configurations would have similar adjustments to the mandrel 26 for bottom forming purposes.

From the foregoing it is believed that those skilled in the pertinent art will recognize the meritorious advancement of this invention and will readily understand that while the present invention has been described in association with a preferred embodiment thereof, and other embodiments illustrated in the accompanying drawings, numerous changes, modifications and substitutions of equivalents may be made therein without departing from the spirit and scope of this invention which is intended to be unlimited by the foregoing except as may appear in the following appended claims. Therefore, the embodiments of the invention in which an exclusive property or privilege is claimed are defined in the following appended claims.

We claim as our invention:

1. An apparatus for forming a blank into an erected carton, the apparatus receiving a series of blanks from a blank feeder, each of the blanks having a predetermined length extending between a bottom of the erected carton and a top of the erected carton, the carton having an octagonal cross-sectional shape, the apparatus comprising:

a plurality of vacuum grips for attaching to each of the blanks, the plurality of vacuum grips capable of transverse movement relative to the length of each of the blanks, and outward movement from each of the blanks at least one of the plurality of vacuum grips engaging the carton on a first side panel of the blank and at least another of the plurality of vacuum grips engaging the carton on a fifth panel of the carton blank in opposing relation to the first panel of the carton blank;

a pusher plate for exerting an inward force on each of the blanks, the pusher plate disposed approximately perpendicular to the plurality of vacuum grips; and a plurality of guides for engaging with each of the blanks which have been formed into an erected carton to maintain the octogonal shape of each of the erected cartons in transit to a bottom forming station.

2. The apparatus according to claim 1 further comprising a stopper plate disposed opposite the pusher plate, the stopper plate capable of exerting an inward force on each of the blanks.

3. The apparatus according to claim 1 wherein the plurality of vacuum grips comprise a first plurality of vacuum grips disposed on one side of a flat blank and a second set of a plurality of vacuum grips disposed opposite the first plurality of vacuum grips.

4. The apparatus according to claim 3 wherein the first plurality of vacuum grips is connected to a moveable frame which is driven by a piston.

5. The apparatus according to claim 3 wherein each of the first and second plurality of vacuum grips are controlled by a linear actuator disposed on the apparatus.

6. The apparatus according to claim 1 further comprising a mandrel configured to substantially match the sides of an erected carton.

7. The apparatus according to claim 6 wherein the mandrel is configured to match a carton having beveled edges along the length of the carton.

8. The apparatus according to claim 1 further comprising a frame having an ingress for receiving each of the blanks in a flat state, and an egress for transferring each of the blanks from the frame in an erected carton state.

9. The apparatus according to claim 8 further comprising a rail disposed between the egress of the frame and a bottom forming station, each of the plurality of guides capable of engaging with the rail for transport of each of the erected cartons from the frame to the bottom forming station.

* * * * *